US011473742B2

(12) United States Patent
Campbell et al.

(10) Patent No.: US 11,473,742 B2
(45) **Date of Patent: *Oct. 18, 2022**

(54) COVE LIGHTING

(71) Applicant: XIQ ACQUISITION CT, LLC, West Haven, CT (US)

(72) Inventors: Leslie L. Campbell, Lake Worth, FL (US); Michael F. Vazzola, Fort Lauderdale, FL (US); Mark E. Lahner, Guilford, CT (US)

(73) Assignee: XIQ ACQUISITION CT, LLC, West Haven, CT (US)

( * ) Notice: Subject to any disclaimer, the term of this patent is extended or adjusted under 35 U.S.C. 154(b) by 338 days.

This patent is subject to a terminal disclaimer.

(21) Appl. No.: 16/826,853

(22) Filed: Mar. 23, 2020

(65) Prior Publication Data

US 2020/0217466 A1 Jul. 9, 2020

Related U.S. Application Data

(63) Continuation of application No. 15/603,803, filed on May 24, 2017, now Pat. No. 10,598,321.

(60) Provisional application No. 62/341,006, filed on May 24, 2016.

(51) Int. Cl.

| | |
|---|---|
| ***F21S 8/00*** | (2006.01) |
| ***E04B 9/30*** | (2006.01) |
| *F21V 21/02* | (2006.01) |
| *F21V 17/00* | (2006.01) |
| *F21V 11/16* | (2006.01) |
| *F21V 21/08* | (2006.01) |
| *F21Y 115/10* | (2016.01) |

(52) U.S. Cl.

CPC ..... *F21S 8/037* (2013.01); *E04B 9/30* (2013.01); *F21V 11/16* (2013.01); *F21V 17/007* (2013.01); *F21V 21/02* (2013.01); *F21V 21/08* (2013.01); *F21Y 2115/10* (2016.08)

(58) Field of Classification Search

USPC ... 52/254, 288.1, 716.1, 255, 718.01, 287.1, 52/289, 720.1

See application file for complete search history.

(56) References Cited

U.S. PATENT DOCUMENTS 1,825,010 A * 9/1931 Murphy ..... E04F 19/0495 52/288.1
2,284,194 A * 5/1942 Gangbin ..... F21V 7/04 362/151
2,428,827 A * 10/1947 Beck ..... F21S 8/037 362/219

(Continued)

OTHER PUBLICATIONS

Light Cove 1066&1026 Section, Sep. 5, 2008, Gordon Interior Specialties Division, Bossier City, Louisiana.

(Continued)

*Primary Examiner* — Joshua K Ihezie
(74) *Attorney, Agent, or Firm* — Cantor Colburn LLP

(57) ABSTRACT

A lighting system for mounting adjacent a junction of a wall and a ceiling of a room comprises: a plurality of lighting fixtures mountable end-to-end along the wall and comprising plurality of mounting extrusions. A transition presents a concave transition facing into the interior of the room and is formed by a plurality of extrusions interfitting with the mounting extrusions.

24 Claims, 5 Drawing Sheets

(56) References Cited

U.S. PATENT DOCUMENTS 2,950,786 A * 8/1960 Markle ..... E04B 1/34315 52/234
2,981,988 A * 5/1961 Schweitzer ..... E04F 19/0436 52/288.1
2,994,905 A * 8/1961 Franker, Jr. ..... E04F 19/0495 52/273
3,047,112 A * 7/1962 Tvorik ..... E04F 19/0436 52/288.1
4,725,931 A * 2/1988 Bourdon ..... F21V 7/0008 362/147
4,748,543 A * 5/1988 Swarens ..... F21S 8/02 362/147
4,881,156 A 11/1989 Shemitz et al.
5,001,877 A * 3/1991 Edwards ..... B44C 5/00 403/295
5,097,401 A * 3/1992 Eppler ..... F21V 7/0008 362/223
5,426,901 A * 6/1995 Indracek ..... E04F 19/0436 52/288.1
5,544,463 A * 8/1996 Bergin ..... E04F 13/06 52/254
5,550,725 A 8/1996 Shemitz et al.
5,555,688 A * 9/1996 Logan ..... E04F 19/0436 52/255
7,040,065 B2 * 5/2006 Pickup ..... E04F 19/0436 52/287.1
7,114,826 B1 * 10/2006 Lilly ..... F21V 21/02 362/146
7,200,970 B2 * 4/2007 Koenig, Jr. ..... E04F 19/02 52/255
7,210,272 B2 * 5/2007 Friday ..... E04F 19/0436 52/211
7,249,870 B1 7/2007 Shwisha
7,451,574 B2 * 11/2008 Spek ..... E04B 9/30 52/288.1
7,658,518 B2 * 2/2010 Shwisha ..... F21S 8/033 362/432
8,562,168 B2 * 10/2013 Napoli ..... F21V 21/02 362/147
9,062,840 B2 * 6/2015 Swisha ..... F21S 8/033
9,726,337 B2 * 8/2017 Hedberg, Jr. ..... F21V 7/0008
10,222,026 B2 * 3/2019 Kim ..... F21S 8/04
10,598,321 B2 * 3/2020 Campbell ..... F21S 8/037
2006/0070285 A1 * 4/2006 Grant ..... G09F 1/00 40/651
2006/0117685 A1 * 6/2006 Kenessey ..... E04F 19/08 52/287.1
2006/0196144 A1 * 9/2006 Spek ..... E04B 9/30 52/716.1
2008/0192462 A1 * 8/2008 Steedly ..... F21V 19/0055 362/218
2013/0314907 A1 * 11/2013 Swisha ..... F21V 21/02 362/147

OTHER PUBLICATIONS

Series 600 Inside Corners, Final Forms I, Unique Trims and Shapes in Prefinished Aluminum, Nov. 14, 2014, Gordon Interior Specialties Division, Bossier City, Louisiana.
Light Coves, Specialty Lighting Applications & Light Troughs, Mar. 10, 2015, Gordon Interior Specialties Division, Bossier City, Louisiana.
U.S. Office Action dated Apr. 30, 2019 for U.S. Appl. No. 15/603,803.

* cited by examiner

COVE LIGHTING

CROSS-REFERENCE TO RELATED APPLICATION

This is a continuation of U.S. patent application Ser. No. 15/603,803, filed May 24, 2017, and entitled "Cove Lighting", which claims the benefit of U.S. Patent Application Ser. No. 62/341,006, filed May 24, 2016, the disclosures of which are incorporated by reference herein in their entireties as if set forth at length.

BACKGROUND OF THE INVENTION

The invention relates to electric lighting. More particularly, the invention relates to light fixtures for indirect lighting.

Well-developed fields exist in indirect lighting and architectural lighting fixtures. A particular area of indirect lighting is known as cove lighting. In a typical cove lighting situation, an upwardly open channel structure is built along a wall near the ceiling. The wall may be a side wall of the room, a sidewall of a recess in the ceiling, a side surface of a beam, or the like. Light bulbs or other light sources are mounted within the channels so that the emitted light escapes generally upward to directly light the wall and ceiling above and, indirectly, an interior of the room and its contents. The channels are built with conventional building techniques involving framing, wallboard installation, plastering, and the like.

Alternatives involve elongate fixtures used for cove lighting. Such fixtures typically include an elongate bulb within an elongate reflector positioned so that light from the bulb and reflector does not directly pass to objects within a room but, rather, is first diffusely reflected from a ceiling, wall, or other architectural feature. Such fixtures may be assembled end-to-end in lieu of placing fixtures within a preexisting channel. Exemplary systems are shown in U.S. Pat. Nos. 4,881,156, 5,550,725, 7,249,870 and 7,658,518. Although its prior art status is unclear, a so-called "edgeless cove" lighting system from Whitegoods Lighting Ltd. has a tapering edge extrusion having a recess which receives wallboard forming the underside of the cove perimeter. U.S. Pat. No. 9,062,840 (the '840 patent) of Swisha et al., issued Jun. 23, 2015, the disclosure of which is incorporated by reference in its entirety herein as if set forth at length, discloses several variations on a recent fixture.

SUMMARY

One aspect of the disclosure involves a lighting system for mounting adjacent a junction of a wall and a ceiling of a room. The system comprises: a plurality of lighting fixtures mountable end-to-end along the wall and comprising plurality of mounting extrusions. A transition presents a concave transition facing into the interior of the room and is formed by a plurality of extrusions interfitting with the mounting extrusions.

In one or more embodiments of any of the foregoing embodiments, the plurality of extrusions comprises: an upper row of extrusions mounted end-to-end; and a lower row of extrusions mounted end-to-end.

In one or more embodiments of any of the foregoing embodiments, spring plates span junctions between the extrusions of each row.

In one or more embodiments of any of the foregoing embodiments, the extrusions of the upper row have a profile having a lower arcuate portion and an upper straight portion and the extrusions of the lower row have a profile having an upper arcuate portion and a lower straight portion.

In one or more embodiments of any of the foregoing embodiments, the arcuate portion of the profile of the extrusions of the upper row is adjacent to the arcuate portion of the profile of the extrusions of the second row.

In one or more embodiments of any of the foregoing embodiments, the system is in an installed condition wherein a skimcoat covers a junction of the ceiling drywall and the upper row.

In one or more embodiments of any of the foregoing embodiments, the plurality of extrusions further includes a spacer row for spanning between the lower row and the mounting extrusions.

In one or more embodiments of any of the foregoing embodiments, the spacer row is secured to the lower row via a projection backlocked in a slot.

In one or more embodiments of any of the foregoing embodiments, clips hold the extrusions of the upper row to the extrusions of the lower row.

In one or more embodiments of any of the foregoing embodiments, the clips each have an extruded channel section and a set screw extending through a base portion of the channel to contact the associated extrusion of the upper row and the associated extrusion of the lower row.

In one or more embodiments of any of the foregoing embodiments, clips hold adjacent said extrusions of a row of the upper row or the lower row to each other and comprise: a main body portion spanning a junction between said adjacent extrusions; and at each respective side of the main body portion, a pair of legs with each leg separated from its adjacent leg by a gap so as to allow the legs to flex relative to the main body portion independently.

In one or more embodiments of any of the foregoing embodiments, the plurality of extrusions are metallic extrusions.

In one or more embodiments of any of the foregoing embodiments, the plurality of extrusions comprise, in profile: an arcuate portion along the concave transition and one or more support webs protruding from a convex side of the arcuate portion for supporting the extrusion against a support surface.

In one or more embodiments of any of the foregoing embodiments, the one or more support webs are L-shaped.

In one or more embodiments of any of the foregoing embodiments, the system is in an installed condition wherein a plurality of screws secure the plurality of extrusions to the support surface.

In one or more embodiments of any of the foregoing embodiments, the plurality of fixtures comprise a plurality of gear trays carried by the mounting extrusions.

In one or more embodiments of any of the foregoing embodiments, the plurality of fixtures further comprise a plurality of trim extrusions mounted to the plurality of mounting extrusions.

In one or more embodiments of any of the foregoing embodiments, the plurality of trim extrusions comprise a rearwardly divergent edge portion.

In one or more embodiments of any of the foregoing embodiments, a method for installing the system comprises: installing a first said extrusion to a room; and installing a second said extrusion end-to-end with the installed first extrusion via a snap engagement with a portion of a clip protruding from the end of the first extrusion.

In one or more embodiments of any of the foregoing embodiments, a method for installing the system comprises:

installing a first said extrusion to a second said extrusion via sliding a channel-sectioned clip over mated web portions of the first extrusion and the second extrusion.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
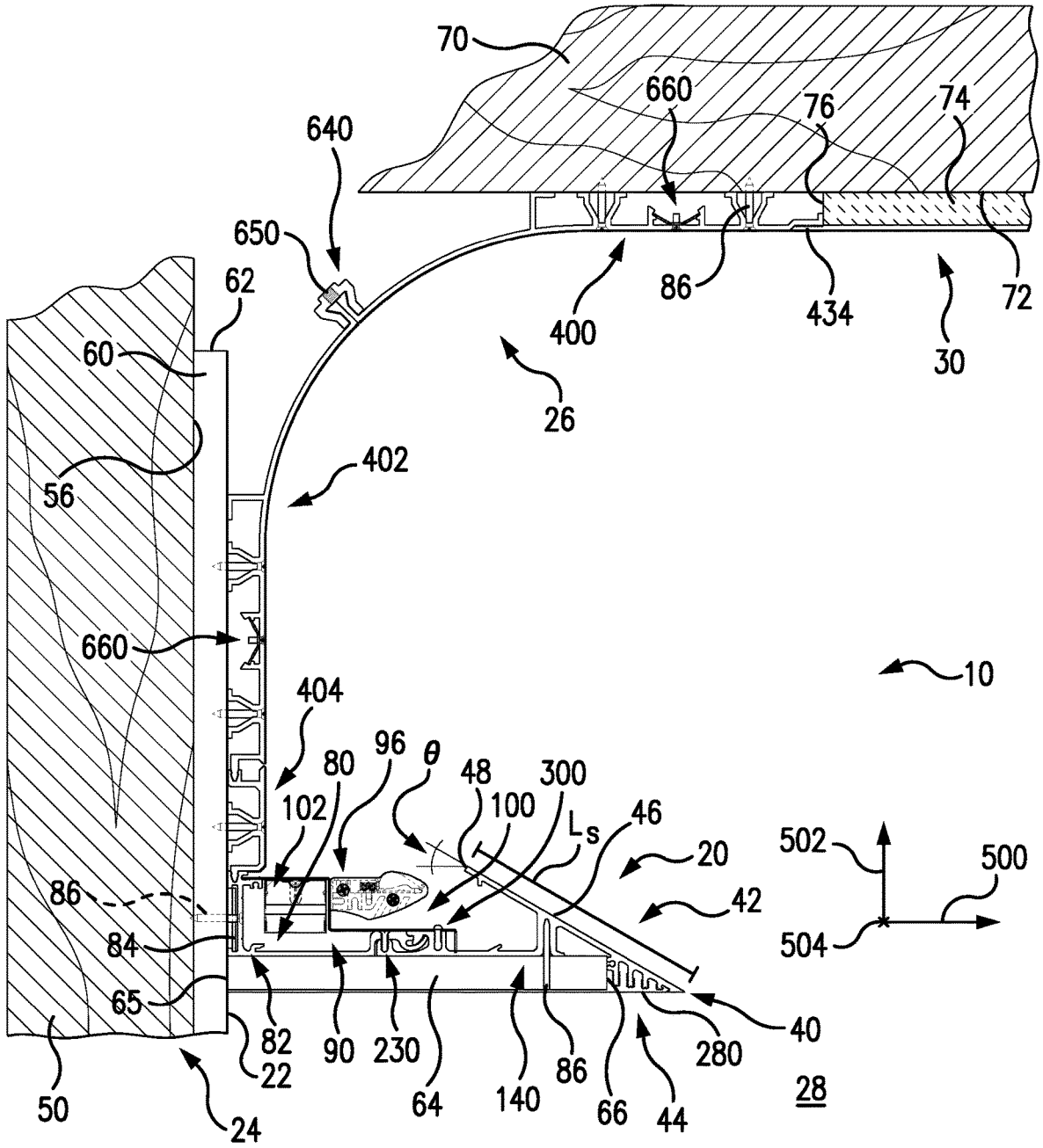
FIG. 1 is a side sectional view of a lighting system.

FIG. 1 shows a lighting system 10 light fixture assembly (fixture) 20 mounted to a surface 22 of a wall 24. The exemplary fixture assembly 20 is based upon a basic structural configuration of the first embodiment of the aforementioned '840 patent. The exemplary mounting situation is slightly different in that the wall 24 of FIG. 1 is shown continuing down below the fixture 20 whereas that shown in the '840 patent ends in a recessed cove situation. However, situations such as the recessed cove situation are also implicated for the present lighting system. Another difference is that the illustrated fixture 20 is mounted to wallboard (drywall) rather than directly to studs or blocking. The wall 24 may be a wall of a room, a wall of a ceiling cove, a side of a structural beam, or the like or combinations.

The exemplary fixture assembly 20 is above a main portion 28 of the room. The fixture assembly may be positioned adjacent to and slightly below a ceiling or ceiling portion 30. The exemplary fixture assembly 20 is a subassembly of a larger system assembly 10 that includes a vanishing corner detail subassembly 26. The subassembly 26 provides a transition between wall and ceiling presenting a concave transition facing into the interior of the room. Thus, the system 10 generally and the subassembly/subsystem 26, particularly, are adjacent the junction of the wall and ceiling and form a transition therebetween. For convenient reference, a forward direction 500 is defined as away from the wall. An upward direction is shown as 502. With left and right defined from the point of view of a person standing upright and facing in the forward direction, the fixture assembly may extend from a left end to a right end in a bi-direction 504.

The assemblies 20 and 26 may each include one, two, or more individual fixture units or subsystem units assembled or otherwise arranged end-to-end. This bi-direction 504 of assembly is identified as longitudinal. In the exemplary installation situation, the wall comprises frame blocking such as provided by a plurality of vertical studs 50 (e.g., dimensional lumber or metallic substitute). The ceiling comprises frame blocking such as provided by a plurality of horizontal joists 70.

The exemplary system 10 provides the appearance of an integral part of the building. In the exemplary implementation, at least portions of the system 10 are installed after installation of adjacent wallboard, finish plastering, and the like. The exemplary installation involves installing structural components of the system 20 after wallboard 60 has been secured to an interior face/edge 56 of the studs 50. It may also be after wallboard 74 has been secured to a lower face/edge 72 of the joists 70. Installation of certain electrical components such as gear trays 100 containing the light sources may come after all wallboard is installed, finish plastering, and even painting.

The exemplary installation involves fastening via screws through to the wall wallboard 60 while fastening via screws directly to the joists 70 outboard of an adjacent edge 76 of the ceiling wallboard 74. One advantage of this mounting situation is it allows the wallboard 74 to be installed after installation of the lighting system. Another advantage is that the gap between wallboard edges 62 and 76 provides access for wiring, etc. to spaces between the joists (even when the ceiling wallboard 74 is preinstalled).

The exemplary fixture 20 presents an aesthetically sharp edge (corner when viewed in section) 40 at the cove opening. The exemplary fixture further provides a tapering region 42 rearwardly diverging from the edge 40. The exemplary tapering region 42 has an underside 44 and an upper surface 46. In the exemplary implementation, the underside 44 is generally horizontal whereas the upper surface 46 extends off horizontal at an angle θ. The exemplary surface 46 has a length $L_S$ (when measured in transverse section from the edge 40 to a rear end/edge 48). Exemplary $L_S$ is 50-200 mm, more particularly, 80-150 mm. An exemplary θ is 20-50°, more narrowly, 30-45°.

In the exemplary implementation, wallboard 60 extends partially along the front face 56 and wallboard 64 extends along the underside of the fixture 20. The wallboard 64 extends from a rear edge 65 to a front edge 66 and has upper and lower surfaces. In the longitudinal direction 504, the wallboard 60, 64, 70 may be represented by multiple edge-to-edge pieces ultimately secured via conventional techniques.

The fixture 20 may comprise several subsystems. A first exemplary subsystem is a wall-mounting subsystem 80. The exemplary subsystem 80 includes an end-to-end array of mounting or support members 82. Exemplary mounting members 82 are extrusions (e.g., of an aluminum alloy) having a convoluted profile (FIG. 3) so as to form the gross features shown and described. Adjacent twos of the members 82 are joined by connector plates 84 (FIG. 2; e.g., aluminum, steel, or plastic) spanning their junctions. The members 82 may be secured to the wall 24 by fasteners 86 (FIG. 1, e.g., screws, toggle fasteners, or the like). Further structural details of the exemplary subsystem 80 and members 82 are discussed below.

A second subsystem is an electrical subsystem 90 (FIG. 1). The exemplary electrical subsystem includes a light source. An exemplary light source may include one or more receptacles. The exemplary electrical subsystem includes units 96 having LED light sources (e.g., strips) directing light generally upward. Examples of such units are seen in US Patent Application Publication No. 20130120974 A1, of Swisha et al., published May 16, 2013, the disclosure of which is incorporated by reference in its entirety herein as if set forth at length. Alternative units may include fluorescent tube-type units. The units are mounted on and carried by a gear tray 100 which in the exemplary embodiment is attached to the wall-mounting subsystem. In FIG. 1, a ballast 102 is shown carried by the tray 100. Unit/tray/ballast combinations may be longitudinally arrayed end-to-end. In several alternative variations, a single ballast may power more than just the adjacent unit(s). Various permutations of known and unknown electrical connections may be used to connect the units to external power (potentially including various daisy chaining of individual units, slaving of individual units, and the like).

A third subsystem is a trim subsystem 140 mounted to the wall-mounting subsystem and provides a structure for forming the edge 40 and tapering region 42. As is discussed further below, the exemplary trim subsystem 140 includes a plurality of extrusions 142 (FIG. 4; e.g., also aluminum alloy) mounted to the extrusions 82.

Figure 3:
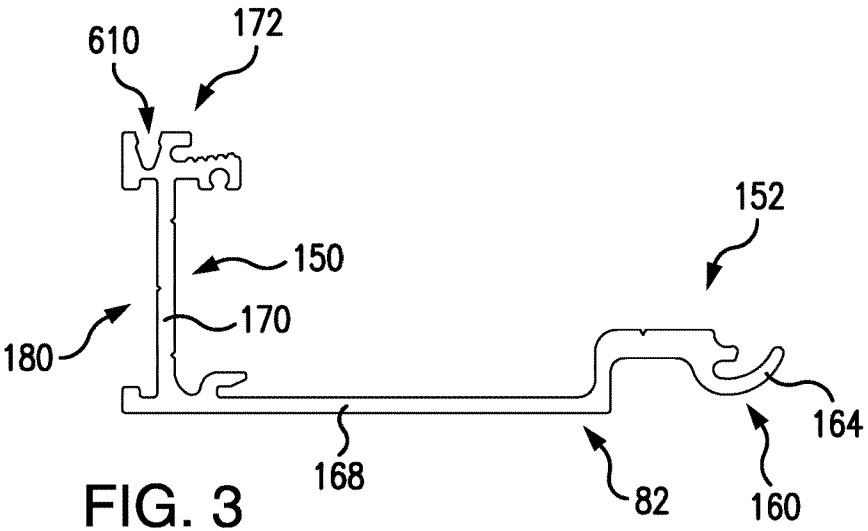
FIG. 3 is an end view of a mounting extrusion.

FIG. 3 shows further details of the extrusion 82. The exemplary extrusion 82 has a rear portion 150 for mating with the mounting surface 22. The exemplary extrusion 82 has a forward portion 152 for mating with the associated trim extrusion(s) 142. At a forward end, the forward portion 152 includes a coupling moiety 160 for engaging a complementary moiety of the trim extrusion(s).

In the portion 150, a vertical web 170 extends upward from the lower horizontal web 168 to an upper rail structure 172. In the exemplary configuration, the web 170 is forwardly shifted from the surface 22 to define an open channel 180 having slightly inwardly protruding upper and lower rims so as to provide a slot for capturing the plates 84. In installation, the rear portion of the mounting extrusion 82 is butted up against the surface 22 and one or more screws 86 are screwed through the web 170 and into the blocking member 50 or other structure. The extrusion 82 may be pre-formed (as extruded) with grooves vertically defining the screwing locations (e.g., for self-drilling screws or for aligning drill bits) or may be pre-drilled post extrusion.

Figure 4:
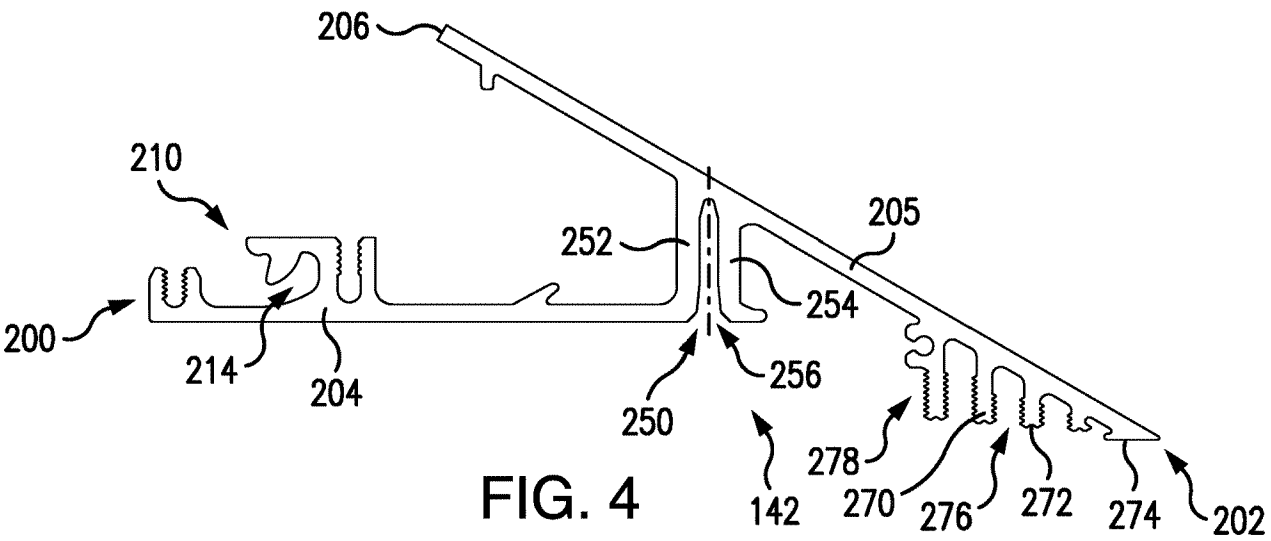
FIG. 4 is an end view of a trim extrusion.

FIG. 4 shows further details of the trim extrusion 142. Each trim extrusion extends from a rear edge 200 to a forward edge 202 (which defines the edge 40). A rear portion (when in the installed condition) 204 is formed as a horizontal web extending forward from the edge 200. An inclined wall 205 extends from the forward edge 202 to a rear edge 206 which defines the edge 48. In the exemplary embodiment, a coupling moiety 210 extends upward from the web 204 for engaging the moiety 160. A coaxial partially annular finger 164 of the moiety 160 is complementary to a channel/slot 214 of the moiety 210. During installation, the trim extrusion is angled front-up and shifted (translated) in a generally downward/rearward direction to insert the finger into the channel. Thereafter, it is rotated front-downward (clockwise as viewed in FIG. 1) to rotate the finger more fully into the channel. This rotation may be stopped by engagement of an end of the finger with an end of the channel to prevent the trim extrusion from falling out of its installed position. The trim extrusion may, however, be further secured by fasteners such as screws 230 (FIG. 1).

FIG. 4 further shows a channel structure 250 joining the web 204 to the inclined wall 206. The structure 250 is defined by an aft wall 252 joining a leading edge of the web 204 to the inclined wall 206 and a forward wall 254. The exemplary channel 256 between the walls 252 and 254 has a filleted/relieved opening/inlet and convoluted sides. The channel 256 serves for capturing fasteners 86 securing the wallboard 64 (FIG. 1).

Depending from the inclined wall 205 near the forward edge 202 are a plurality of walls 270 whose lower ends 272 are slightly vertically recessed above a flat surface 274 extending rearwardly from the edge 202. This vertical recessing and the channels 276 between the walls and a gap 278 aft of the trailing wall all provide volume for accommodating a skim coat 280 (FIG. 1) applied after the fastening of the wallboard 64. Additional finishing steps may be as conventional in the drywalling art. The gear tray may be installed via a downward translation in an initially angled condition followed by a rearward shift and front-down rotation. The exemplary gear trays and mounting extrusions have interfitting features for holding the gear trays in position. Additionally, once interfitted, screws 300 may secure the gear trays in place.

As is discussed above, the exemplary vanishing corner detail subassembly 26 includes a plurality of end-to-end arrays of extrusions. From top-to-bottom, this comprises an upper row of extrusions 400, a lower row of extrusions 402, and a row of spacer extrusions 404. In the exemplary implementation, the extrusions 400 and 402 combine to provide the arcuate transition and the extrusions 404 join the arcuate transition to the extrusions 82 of the fixtures.

Figure 5:
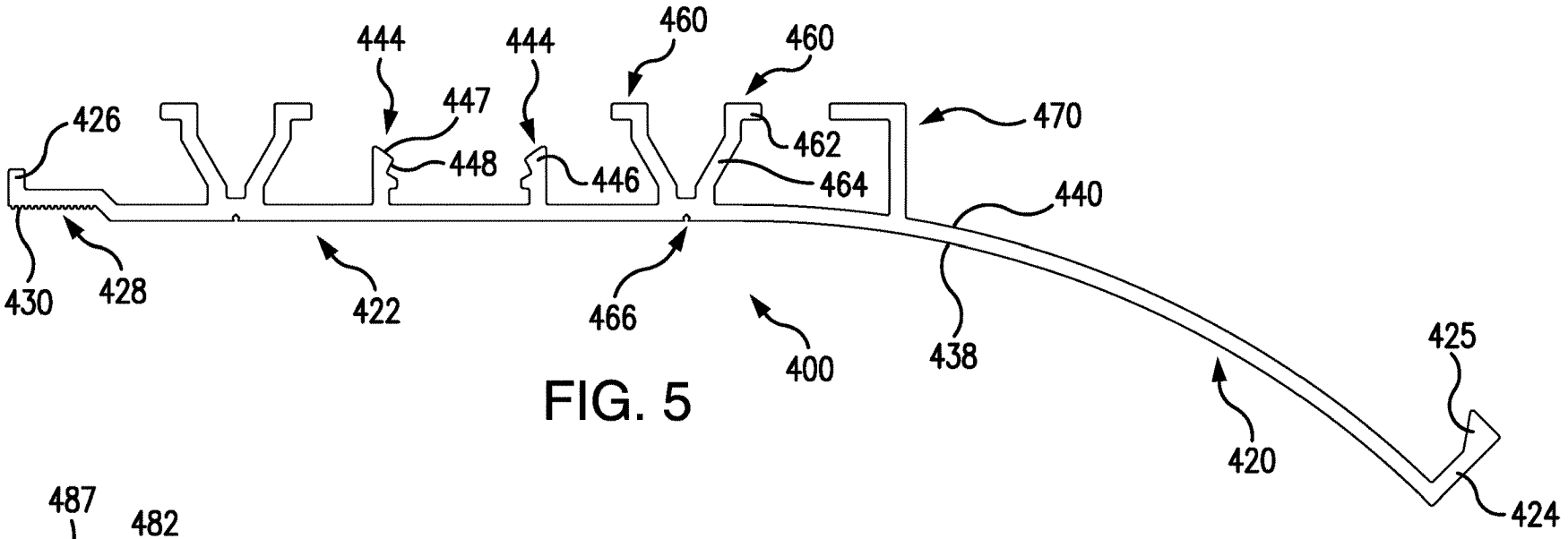
FIG. 5 is an end view of an upper transition extrusion.
Figure 6:
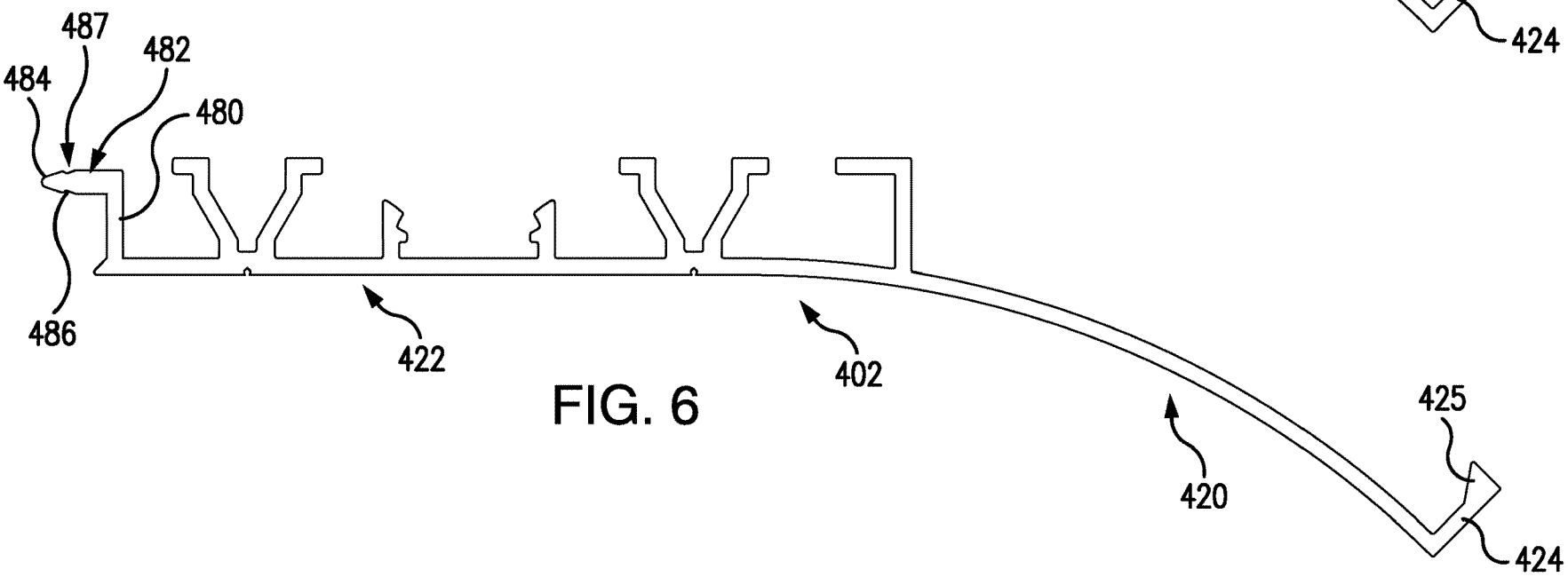
FIG. 6 is an end view of a lower transition extrusion.
Figure 8:
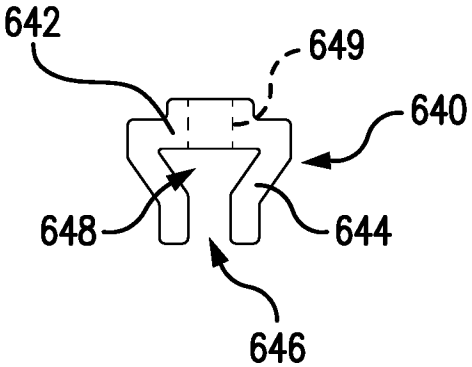
FIG. 8 is an end view of a first clip for connecting upper and lower transition extrusions.

The upper extrusions 400 (FIG. 5) have a profile having an arcuate lower portion 420 and an upper straight portion 422. At the lower extreme of the arcuate portion 420, a lower end of the extrusion is formed by a flange 424. The exemplary lower extrusions have similar arcuate 420 and straight 422 portions with the arcuate portion being an upper portion. The flanges 424 of the upper and lower extrusions abut in an installed condition and may be captured within a clip 640 (FIG. 1). The exemplary clip 640 is formed of extruded aluminum alloy in a channel-like section having a base portion 642 (FIG. 8) and side portions 644. The side portions converge towards an opening 646. The interior thus forms a channel 648 having a relatively broad base and a relatively narrow neck. This allows the clip to be slid laterally over the abutted flanges 424 with the broadened base capturing foot portions 425 (FIGS. 5 and 6) of the flanges to prevent extraction from the clip. A set screw 650 (FIG. 1) may be threaded through a hole 649 the base 642 to abut ends of the flanges 424 and retain the clip in place.

Figure 2A:
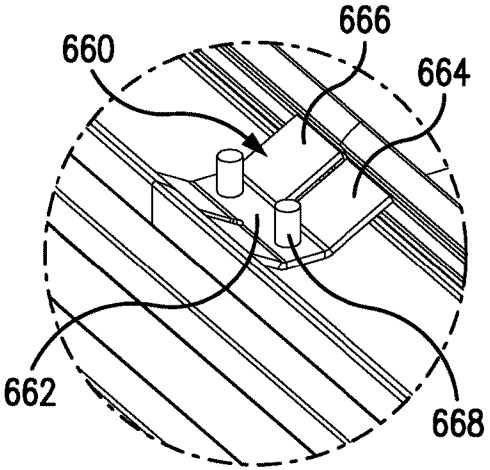
FIG. 2A is an enlarged view of a first junction between upper extrusions.
Figure 2B:
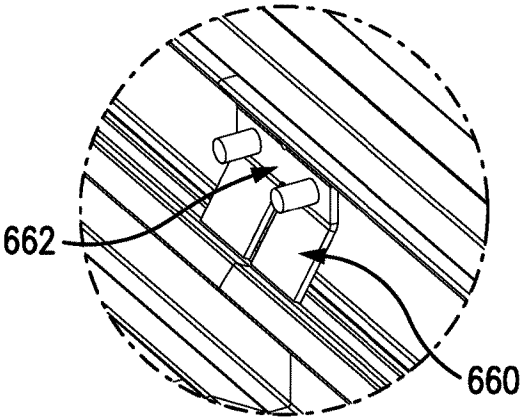
FIG. 2B is an enlarged view of a first junction between lower extrusions.
Figure 2:
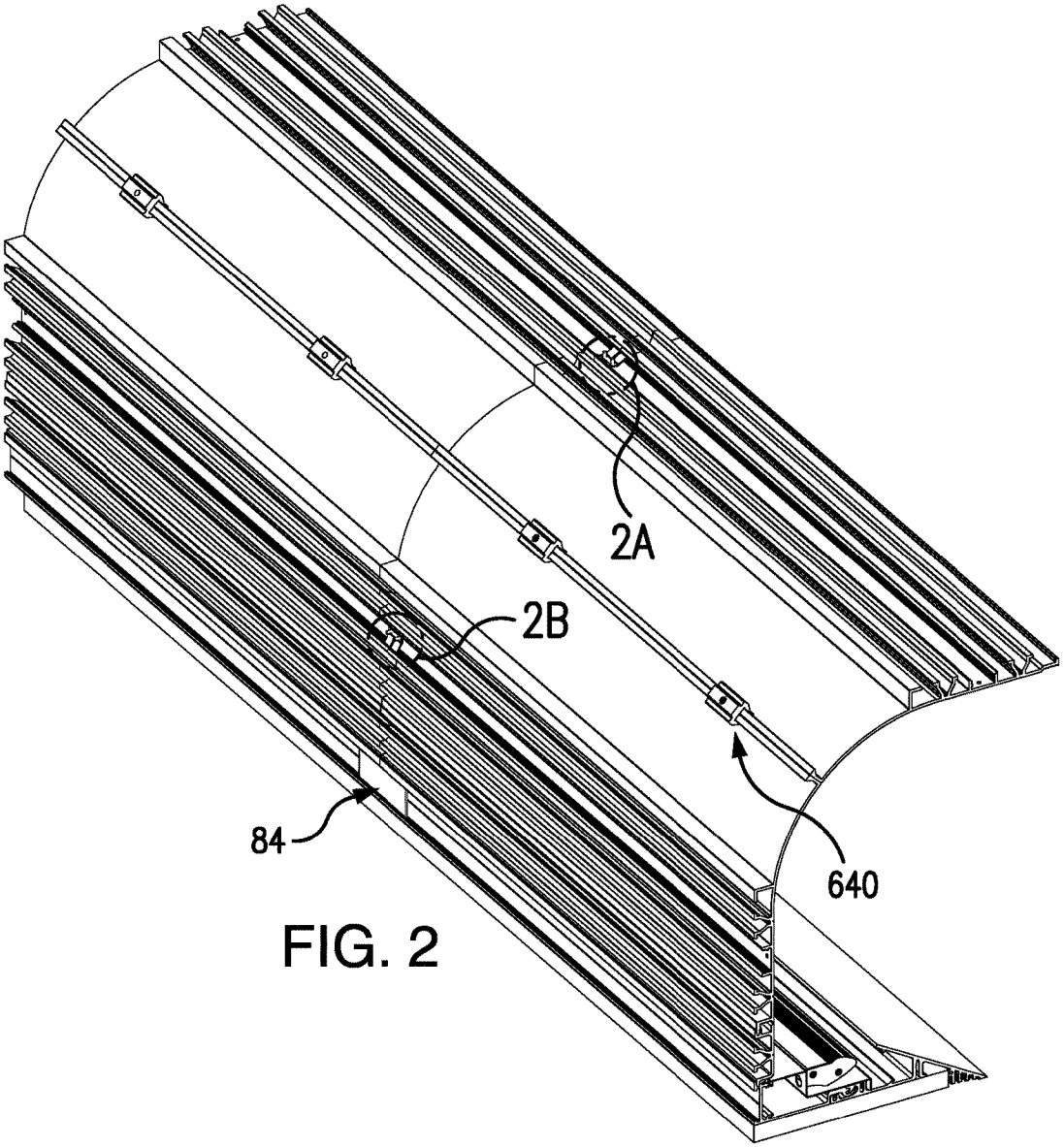
FIG. 2 is a rear perspective view of the system shown removed from a room.
Figure 9:
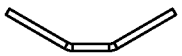
FIG. 9 is an end view of a second clip for connecting adjacent extrusions in a given row of extrusions.

An upper end of the upper extrusion 400 (FIG. 5) is formed by a flange 426. The flange 426 is at the end of a recessed area 428. The recessed area includes serrations or other texturing 430 to allow receipt of a skim coat 434 when the web 426 is abutted to the end 82 (FIG. 1) of the wallboard 74. The extrusion has a main body portion along the portions 420 and 422 and a plurality of mounting features extending from an exterior (outboard) surface 440 thereof. These include pairs of opposed webs 444 for capturing clips 660 (FIGS. 2A, 2B, and 9). The clips 660 may be formed, for example, from aluminum, spring steel, or other metal or non-metallic material. Each of the clips 660 has a main body portion 662 spanning the junction/seam between two adjacent extrusions. At each respective side of the body 662, the clip has a pair of legs 664, 666 with each leg 664 separated from its adjacent leg 666 by a gap so as to allow them to flex relative to the body independently. The webs 444 have associated barb portions 446 having outboard camming surfaces 447 and inboard undersides or capturing surfaces 448. The clip 660 may be secured via translation with undersides of end portions of the pair of legs 664 or 666 encountering the camming surfaces 447 to fold the legs slightly inward then passing over apexes to be captured by the undersides 448. Lateral movement of the clip may be prevented by screws 668, rivets, or other similar fasteners extending through holes in the body 662 and associated holes in the extrusion.

The features extending from the surface 440 also include pairs of support webs 460. The exemplary webs 460 of each pair have outwardly opposed feet 462 and outwardly divergent legs 464. The divergent legs provide a wide accommodation for a screw 86 (FIG. 1). As with the other extrusions, screwing grooves 466 are extruded along the exposed inboard (room-facing) surface 438 to provide easy reference for the installer. In the exemplary embodiment, an L-sectioned web 470 is also included to support the arcuate portion 420.

Figure 7:
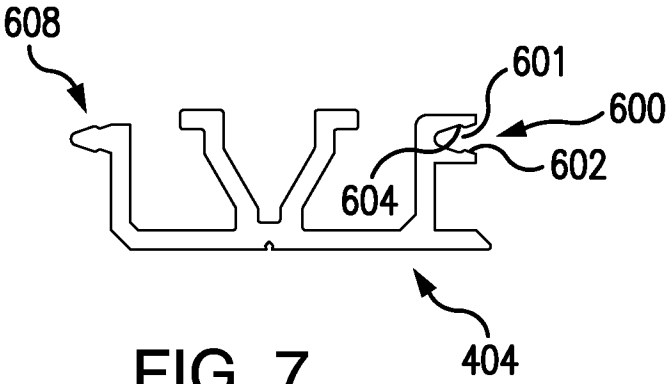
FIG. 7 is an end view of a spacer extrusion.

The extrusions 402 and 400 are generally similar. In the exemplary embodiment, the extrusions 402 differ from the extrusions 400 only in the features at the lower end of the extrusion 402 differing from those of the upper end of the extrusion 400. The lower end comprises a rearwardly directed flange 480 with a terminal downwardly directed portion 482. The portion 482 has a tapering end 484 defining a protuberant bead with underside surfaces 486 extending to a neck 487). These can become captured (such as via snap fit or translation) in a complementary channel 600 (FIG. 7) in the extrusion 404 (e.g., the channel 600 has a narrowed region 601 with outboard camming surfaces 602 to guide snap insertion if a snap-in mechanism is used and surfaces 604 to resist extraction by abutting the surface of neck 487 of the projection). In a similar fashion, the exemplary extrusion 404 has a lower projection 608 generally similar to the projection 482 for receipt in a complementary channel 610 (FIG. 3) in the upper rail structure 172 of the extrusion 82.

For manufacturing and shipping purposes, the extrusions may be formed in one or more standard lengths. One exemplary length is standard US 8-foot length. If shorter pieces are required to complete a given leg of a system, these may be cut from the stock material. Alternatively, smaller standard sizes may also be provided such as 4-foot and 6-foot or their SI/metric equivalent for countries outside the US. In the exemplary system, the length and nature of the individual lighting trays may be influenced by the particular bulbs desired to be used. Trays may be assembled end-to-end and, therefore, do not have to correspond to length of the extrusions. The selection of trays and their arrangement may be made to provide even lighting along the length of any given leg or to provide a desired variation in light along that leg. Trays may overlap junctions between extrusions.

Exemplary depths between the fixture forward edge and the mounting surface of the blocking member are approximately 6-18 inches with particular examples in the range of 8-13 inches. For example, an exemplary 8.625 inch length when used with 0.625 inch wallboard results in an 8-inch protrusion. Thus, nominal protrusions of 8, 10, and 12 inches might be made available in a given series of fixtures. SI/metric equivalents could also be provided.

An exemplary installation sequence involves cutting one or more of the extrusions to length (e.g., a given number of full-length pieces may be used followed by one length cut to make up the gap). Pairs of the extrusions 402 or 404 may be secured to each other via the clips 640 and associated set screws. Additionally, if present, the extrusions 404 may be snapped or slid into engagement with the extrusions 402. Depending upon implementation, this may occur after the extrusions 82 have been installed to the wall, before the extrusions 82 are installed to the wall, or the extrusions 82 may also be attached to the extrusions 404 prior to assembly to the wall.

At one end of the extrusions, the clips 660 and their associated screws 668 may be installed. This may require drilling holes for the screws 668 in the extrusion 400 if not already drilled at the factory. The assembly may then be installed to the wall via the screws 86. The next set of extrusions may be assembled in a similar fashion and then snapped into place. Shifting the extrusions inward toward the wall in the ceiling allows the free legs 666 or 664 to be received by the webs 444 in the snapping engagement discussed above. The second screw 668 may be added if needed. Transitions, corners, etc. may be similarly installed.

The mounting members 82 may be installed. This exemplary sequence may obviate the need for the connector plates 84 with the extrusions 404 aligning the mounting members 82. The trim extrusions 142 may then be attached. Transitions, corners, etc. may be similarly installed. Alternatives might involve installing the mounting extrusions 82 first.

The exemplary system may have a number of utilitarian advantages. The vanishing corner detail subassembly 26 prevents the viewer from perceiving the corner of the room (which he would otherwise perceive due to a change in lighting at the corner between ceiling and wall wallboard.

Other advantages involve economy of contractors/manufacture. For example, different contractors may serve different purposes. Minimizing the number of visits by a given contractor may be achieved. Flexibility is involves such as by not allowing the gap between ceiling and wall wallboard while not needing the wallboard installer to return to close the gap between wall and ceiling wallboard.

The fixture system may be made using otherwise conventional or yet-developed materials and techniques.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments of the present invention have been described. Nevertheless, it will be understood that various modifications may be made without departing from the spirit and scope of the invention. For example, various elements may be combined or further separated. Additionally, a variety of structural shapes and cooperating features of the extrusion are possible. Various other manufacturing techniques and materials may be used. Multiple bulb and multiple reflector embodiments are also possible. Architectural/design considerations may influence any particular implementation, giving rise to the possibility of mounting on non-vertical surfaces and mounting in non-horizontally extending arrays. Accordingly, other embodiments are within the scope of the following claims.

What is claimed is:

1. A lighting system for mounting adjacent a junction of a wall and a ceiling of a room, the system comprising:

a lighting fixture mountable along the wall and comprising a mounting extrusion; and a transition presenting a concave transition facing into an interior of the room and formed by an extrusion interfitting with the mounting extrusion;

wherein the extrusion of the transition comprises:

an upper row extrusion; and a lower row extrusion;

wherein the upper row extrusion has a profile having a lower arcuate portion and an upper straight portion; and wherein the lower row extrusion has a profile having an upper arcuate portion and a lower straight portion.

2. The system of claim 1 wherein:

the arcuate portion of the profile of the upper row extrusion is adjacent to the arcuate portion of the profile of the lower row extrusion.

3. The system of claim 2 in an installed condition wherein:

a skimcoat covers a junction of the ceiling drywall and the upper row extrusion.

4. The system of claim 3 further comprising:

a spacer row spanning between the lower row extrusion and the mounting extrusion.

5. The system of claim 4, wherein the spacer row is secured to the lower row extrusion via a projection back-locked in a slot.

6. The system of claim 1, further comprising:

a clip holding the upper row extrusion to the lower row extrusion.

7. The system of claim 6 wherein:

the clip has an extruded channel section and a set screw extending through a base portion of the channel to contact the associated upper row extrusion and the associated lower row extrusion.

8. The system of claim 1 further comprising:

a clip configured to hold a row of adjacent upper row extrusions or lower row extrusions to each other and comprising:

a main body portion spanning a junction between said adjacent extrusions; and at each respective side of the main body portion, a pair of legs with each leg separated from its adjacent leg by a gap so as to allow the legs to flex relative to the main body portion independently.

9. The system of claim 1, wherein at least one of the mounting extrusion, the upper row extrusion, and the lower row extrusion is are a metallic extrusion.

10. The system of claim 1, wherein the extrusions of the transition comprise, in profile:

one or more support webs protruding from a convex side of the arcuate portion for supporting the respective extrusion against a support surface.

11. The system of claim 10 wherein:

the one or more support webs are L-shaped.

12. The system of claim 11 in an installed condition wherein:

a screw secures the extrusions to the support surface.

13. The system of claim 1, wherein the fixture comprises:

a gear tray carried by the mounting extrusion.

14. The system of claim 13, wherein the fixture further comprises:

a trim extrusion mounted to the mounting extrusion.

15. The system of claim 14, wherein the trim extrusion comprises:

a rearwardly divergent edge portion.

16. The system of claim 1, wherein the mounting extrusion and the extrusion of the transition are formed by an extrusion process.

17. A method for installing a lighting system for mounting adjacent a junction of a wall and a ceiling of a room, the system comprising a lighting fixture mountable along the wall and comprising a mounting extrusion, and a transition presenting a concave transition facing into an interior of the room and formed by an extrusion interfitting with the mounting extrusion, the method comprising:

installing a first said extrusion to a room; and installing a second said extrusion end-to-end with the installed first extrusion via a snap engagement with a portion of a clip protruding from the end of the first extrusion.

18. The system of claim 17, wherein the mounting extrusion and the extrusion interfitting with the mounting extrusion are formed by an extrusion process.

19. A method for installing a lighting system for mounting adjacent a junction of a wall and a ceiling of a room, the system comprising a lighting fixture mountable along the wall and comprising a mounting extrusion, and a transition presenting a concave transition facing into an interior of the room and formed by an extrusion interfitting with the mounting extrusion, the method comprising:

installing a first said extrusion to a second said extrusion via sliding a channel-sectioned clip over mated web portions of the first extrusion and the second extrusion.

20. The system of claim 19, wherein the mounting extrusion and the extrusion interfitting with the mounting extrusion are formed by an extrusion process.

21. A lighting system for mounting adjacent a junction of a wall and a ceiling of a room, the system comprising:

a lighting fixture mountable along the wall and comprising a mounting extrusion; and a transition presenting a concave transition facing into an interior of the room and formed by an extrusion interfitting with the mounting extrusion;

wherein the extrusion of the transition comprises:

an upper row extrusion; and a lower row extrusion;

wherein the system further comprises:

a clip holding the upper row extrusion to the lower row extrusion.

22. The system of claim 21, wherein the mounting extrusion and the extrusion of the transition are formed by an extrusion process.

23. A lighting system for mounting adjacent a junction of a wall and a ceiling of a room, the system comprising:

a lighting fixture mountable along the wall and comprising a mounting extrusion; and a transition presenting a concave transition facing into an interior of the room and formed by an extrusion interfitting with the mounting extrusion;

wherein the extrusion of the transition comprises:

an upper row extrusion; and a lower row extrusion;

wherein the system further comprises:

a clip configured to hold a row of adjacent upper row extrusions or lower row extrusions to each other and comprising:

a main body portion spanning a junction between said adjacent extrusions; and at each respective side of the main body portion, a pair of legs with each leg separated from its adjacent leg by a gap so as to allow the legs to flex relative to the main body portion independently.

24. The system of claim 23, wherein the mounting extrusion and the extrusion of the transition are formed by an extrusion process.

* * * * *